US008284049B2

(12) United States Patent
Blanchard

(10) Patent No.: US 8,284,049 B2
(45) Date of Patent: Oct. 9, 2012

(54) SENSING AND REPORTING DEVICES, SYSTEMS AND METHODS

(75) Inventor: William C. Blanchard, Phoenix, MD (US)

(73) Assignee: KWJ Engineering, Newark, CA (US)

( * ) Notice: Subject to any disclaimer, the term of this patent is extended or adjusted under 35 U.S.C. 154(b) by 483 days.

(21) Appl. No.: 12/575,969

(22) Filed: Oct. 8, 2009

(65) Prior Publication Data

US 2010/0090828 A1 Apr. 15, 2010

Related U.S. Application Data

(60) Provisional application No. 61/103,605, filed on Oct. 8, 2008.

(51) Int. Cl.
*G08B 1/08* (2006.01)

(52) U.S. Cl. ..... 340/539.26; 340/691.7

(58) Field of Classification Search ..... 340/539.26, 340/540, 691.7, 568.1, 545.6, 531
See application file for complete search history.

(56) References Cited

U.S. PATENT DOCUMENTS

| | | | | |
|---|---|---|---|---|
| 6,499,353 | B1 * | 12/2002 | Douglas et al. | 73/722 |
| 6,870,476 | B2 * | 3/2005 | Cockburn et al. | 340/568.1 |
| 6,927,688 | B2 * | 8/2005 | Tice | 340/539.26 |
| 2004/0113783 | A1 * | 6/2004 | Yagesh | 340/568.1 |
| 2004/0119588 | A1 * | 6/2004 | Marks | 340/539.1 |
| 2005/0151643 | A1 * | 7/2005 | Rajapakse et al. | 340/539.26 |
| 2006/0181413 | A1 * | 8/2006 | Mostov | 340/531 |
| 2008/0272906 | A1 * | 11/2008 | Breed | 340/539.26 |

* cited by examiner

*Primary Examiner* — Thomas Mullen
(74) *Attorney, Agent, or Firm* — Dinsmore & Shohl LLP

(57) ABSTRACT

Environmental sensing devices, systems and methods are provided. In one embodiment, an environmental sensing device includes an environmental sensor and an internal signal generator. The environmental sensing device may be configured to be mechanically coupled to one or more interior surfaces of an enclosure. The environmental sensor may be operable to detect one or more substances within the enclosure and provide a status signal to the internal signal generator corresponding to the presence of the one or more substances. The internal signal generator may be operable to generate a mechanical report sequence corresponding to the status signal. The mechanical report sequence may be a series of mechanical pulses applied to an interior surface of the enclosure.

20 Claims, 3 Drawing Sheets

SENSING AND REPORTING DEVICES, SYSTEMS AND METHODS

CROSS REFERENCE TO RELATED APPLICATIONS

This patent application claims priority to U.S. Provisional Application No. 61/103,605, filed Oct. 8, 2008 and entitled "Apparatus and Method for Sensing, Surveillance and Safety Monitoring," the entirety of which is incorporated by reference.

TECHNICAL FIELD

Embodiments of the present disclosure generally relate to sensor devices and, more specifically, sensor devices, systems, and methods that wirelessly report a sensor status by mechanical report sequences.

BACKGROUND

Presently there are millions of shipping containers that enter and leave ports throughout the world. Under the current political and social climate, each container must be inspected to determine whether the container contains contraband such as narcotics, nerve or mustard gas, explosives, nuclear material and the like. Sensors that detect contraband are often placed within the container, thus requiring a communication means to communicate with a receiving or transmitting device that is external to the container.

Conventional shipping containers comprise thick metal walls that prevent electromagnetic signals from passing through the wall. Therefore, wireless communication between an internal sensor within the container and an external receiver/transmitter is very difficult. Solutions to the internal and external communication problem have included heat, x-ray, or wiring methods in which a hole is drilled in the wall of the container. These solutions are costly and undesirable.

Accordingly, a need exists for alternative sensors capable of wirelessly reporting a status to an exterior of an enclosure such as a shipping container.

SUMMARY

In one embodiment, an environmental sensing device includes an environmental sensor, and an internal signal generator. The environmental sensing device may be configured to be mechanically coupled to one or more interior surfaces of an enclosure. The environmental sensor may be operable to detect one or more substances within the enclosure and provide a status signal to the internal signal generator corresponding to the presence of the one or more substances. The internal signal generator may be operable to generate a mechanical report sequence corresponding to the status signal. The mechanical report sequence may be a series of mechanical pulses applied to an interior surface of the enclosure.

In another embodiment, an environmental sensing system includes an internal sensor device and an external device. The internal sensor device may include an environmental sensor, an internal signal generator, and an internal signal receiver. The external device may include an external signal receiver. The internal sensor device may be configured to be mechanically coupled to one or more interior surfaces of an enclosure. The environmental sensor may be operable to detect one or more substances within the enclosure and provide a status signal corresponding to a presence of the one or more substances. The internal signal generator may be operable to receive the status signal from the environmental sensor and upon receipt of a mechanical external signal generate a mechanical report sequence corresponding to the status signal. The mechanical report sequence may be a series of mechanical pulses applied to an interior surface of the enclosure. The external signal receiver may be operable to receive and decode the mechanical report sequence to generate a decoded status signal.

In yet another embodiment, a method of reporting a status of an enclosure includes providing a mechanical external signal comprising a series of mechanical pulses applied to an exterior surface of an enclosure and receiving the mechanical external signal by an internal sensor device positioned within the enclosure. The method further includes determining a status of the enclosure and providing a status signal corresponding to the status of the enclosure. The internal sensor device may generate a mechanical report sequence in response to the receipt of the mechanical external signal. The mechanical report sequence may be a series of mechanical pulses applied to an interior surface of the enclosure and may correspond with the status signal.

The method may further include receiving the mechanical report sequence and decoding the mechanical report sequence to generate a decoded status signal.

These and additional features provided by the embodiments of the present invention will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION

It is against this background that it is desired to have devices, systems and methods for reliable and cost-effective wireless communication between an internal sensor device and an external device that is separated by a wall. Embodiments of the present disclosure are generally related to environmental sensing devices, systems, and methods for sensing enclosures and other spaces for one or more substances and wirelessly reporting a status indicating a presence of a substance (or lack of presence) by a series of mechanical pulses. More specifically, embodiments may provide wireless communication between an internal sensor device and an external device wherein the internal device and external device are separated by a wall or divider, such as an EMI shielded wall. Although embodiments may be described with reference to use in conjunction with containers, use of embodiments described herein are not limited thereto. The term "enclosure" means any space where a structure such as a wall prevents wireless communication via electromagnetic signals, visual signals or other similar signaling means. An enclosure may be a container, a room, industrial equipment (e.g., a boiler or a coal gasifier), or a space separated by a divider, for example.

Although embodiments may be described in the context of environmental sensors capable of detecting substances, embodiments described herein are not limited thereto. For example, rather than sensing for a substance, a sensor or sensors of some embodiments may be configured to detect a status or statuses of an enclosure, such as temperature, pressure, or other status parameters. Embodiments described herein may be utilized in any situation where passing a signal from an interior region of an enclosure to an exterior region of an enclosure by RF signals, x-rays, wired communications links (e.g., a wire passed through a hole drilled in a side of the enclosure) or other methods is impractical or undesirable. However, it should be understood that embodiments described herein may also be utilized in conjunction with communication methods such as RF signals, x-rays, wired communications links or other methods.

Figure 1:
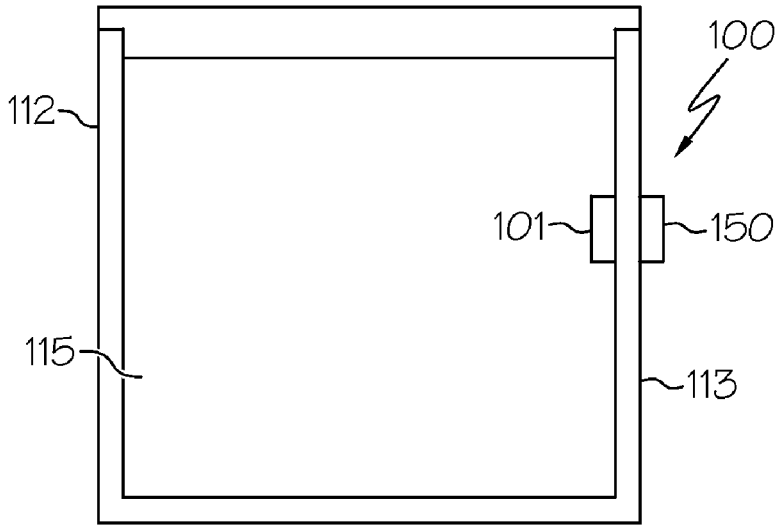
FIG. 1 depicts a schematic illustration of a cross sectional view of an internal sensor device and an external device coupled to a container according to one or more embodiments illustrated and described herein.
Figure 2:
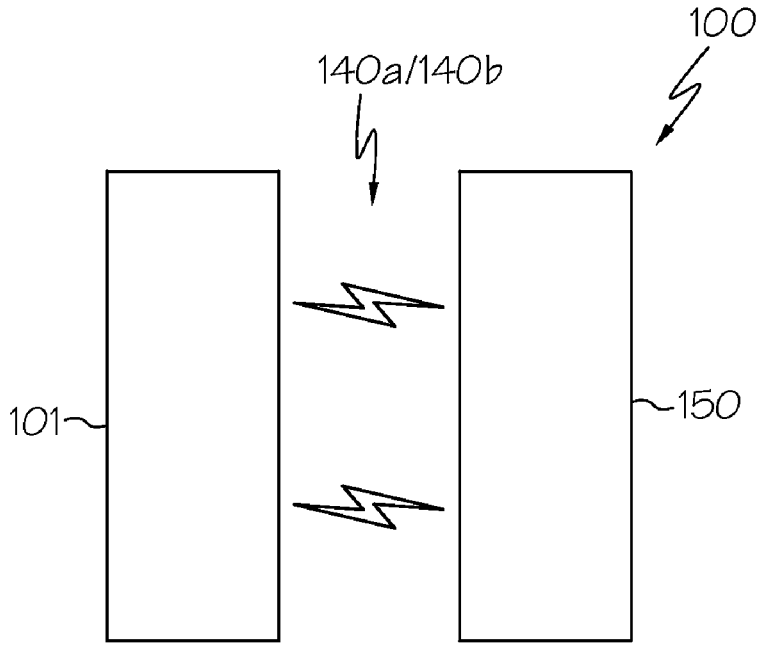
FIG. 2 depicts a schematic illustration of a communication between an internal sensor device and an external device according to one or more embodiments illustrated and described herein.

FIGS. 1 and 2 generally illustrate one embodiment of an environmental sensing system 100 coupled to a wall 113 of a container 112. The container 112 defines an enclosure 115 in which an internal sensor device 101 (i.e., an environmental sensing device) may be maintained on an interior surface of a wall 113. The mounting of the internal sensor device 101 may be effectuated by a permanent magnet, adhesive, or other similar mounting methods. The internal sensor device 101 may be configured as an environmental sensor device having an environmental sensor 102 that is configured to take data related to particular substances or other status parameters. The environmental sensor 102 acquiring the data within the container 112 may be configured for detecting any number of materials, such as narcotics, nerve or mustard gas, explosives, concealed people, or nuclear material, etc.

An external device 150 may be temporarily (or permanently) positioned outside the shipping container 112 on an external surface of the wall 113. The internal sensor device 101 and external device 150 are configured to wirelessly communicate by mechanical pulses 140*a*/140*b* applied to the wall 113. As described herein, the mechanical pulses may be acoustic pulses, vibratory pulses, ultrasonic pulses, and the like. The internal sensor device 101 may collect data related to substances that may or may not be present in the container, generate a status signal, and wirelessly transmit the status signal by providing a corresponding mechanical report sequence 140*a* comprising a series of mechanical pulses to the wall 113. The external device 150 may then receive and decode the mechanical report sequence 140*a* to determine the status of the internal sensor device 101 and whether or not substances have been detected within the enclosure 115. In one embodiment, a human may take the place of the external device 154 by listening or feeling the mechanical report sequence 140*a* on the wall 113 of the container 112. In this embodiment, an external device 150 may not be necessary.

In one embodiment, the internal sensor device 101 may be configured to provide a mechanical report sequence 140*a* at regular intervals in accordance with a signal generating schedule. For example, the internal sensor device 101 may be programmed to provide a mechanical report sequence 140*a* every three minutes. In this embodiment, a user wanting to determine whether a particular container has a contraband substance contained therein may wait for a mechanical report sequence to be transmitted. In another embodiment, the internal sensor device 101 may be configured to receive a mechanical external signal 140*b* from the exterior of the enclosure 115 to start an interrogation process. The internal sensor device 101 will only respond with a mechanical report sequence 140*a* when interrogated by a mechanical external signal 140*b*. The mechanical external signal 140*b* may be generated, for example, by a mechanical pulse applied to an exterior surface of the wall 113. The mechanical pulse may be applied by a person striking the wall 113 with a hammer or other hard object. In another embodiment, the external device 150 may be configured to apply the mechanical external signal 140*b* to the wall 113 with mechanical, vibratory, acoustic or ultrasonic pulses.

Figure 3:
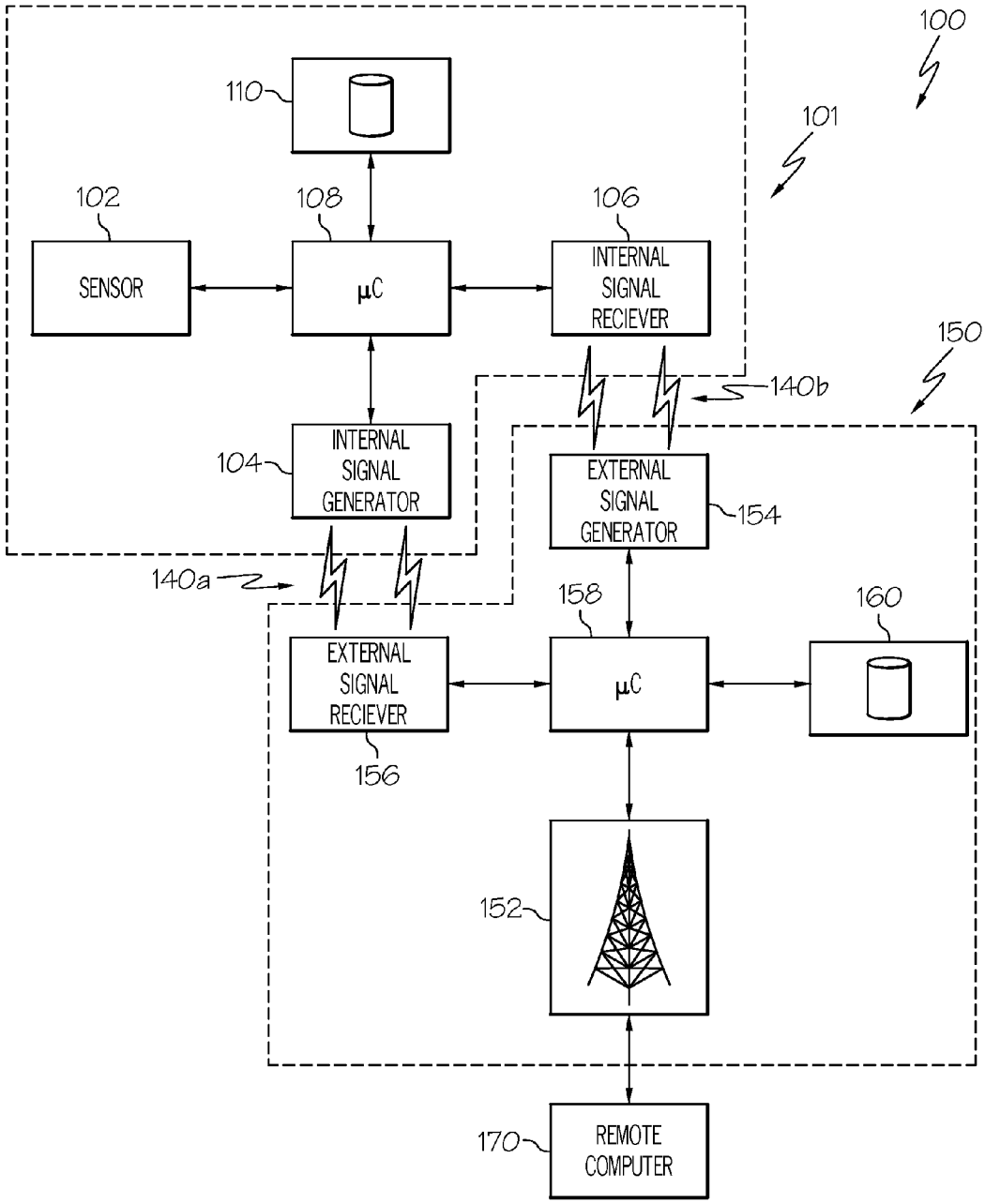
FIG. 3 depicts a schematic illustration of components within an exemplary environmental sensing system according to one or more embodiments illustrated and described herein.

FIG. 3 illustrates the components of an exemplary environmental sensing system 100 in greater detail. As described above, the system 100 may comprise an internal sensor device 101 and an external device 150. In other embodiments, the external device 150 may not be included within the system 100 but rather an external signal 140*b* may be generated by a user by striking a hammer on a wall of a container, and the mechanical report sequence 140*a* may be received and decoded by a user by listening or feeling the series of pulses of the mechanical report sequence 140*a*.

The internal sensor device 101 may comprise an environmental sensor 102, an internal signal generator 104, an internal signal receiver 106, a controller 108, and an internal sensor memory 110. It should be understood that not all of the elements illustrated in FIG. 3 are necessary for operation of the system 100. For example, in embodiments wherein the internal sensor device 101 provides a mechanical report sequence 140*a* in time intervals without an interrogation sequence, the internal signal receiver 106 may not be needed. Further, some embodiments may utilize more than one controller 108 or no controller. For example, the environmental sensor 102, the internal signal generator 104, and internal signal receiver 106 may all comprise an individual controller and communicate over a communications bus. Additionally, the internal sensor device 101 may or may not have an internal sensor memory 110. The components of the internal sensor device 101 may be powered by battery, by a differential thermo to electrical converter, or any acceptable power methods.

The external device 150 of the illustrated embodiment comprises an external signal generator 154, an external signal receiver 156, and a controller 158. The controller 158 may enable the external signal generator 154 and the external signal receiver 156 to cooperate with one another. As described above with reference to the internal sensor device 101, more than one controller or no controller may be utilized. The external device 150 may also comprise a communications module 152 operable to transmit a decoded status signal to a remote computer 170, and an external device memory 160 operable to store received status signals. It should be understood that the components of the internal sensor device 101 may be maintained within a single internal sensor device 101, or as individual components in electrical communication with one another. Similarly, the components of the external device 150 may also be maintained within a single external device or as individual components.

The external device 150, which may be a portable device that is temporarily mounted on the wall of a container, may apply a mechanical external signal 140*b* via the external signal generator 154. The mechanical external signal 140*b* may be a series of acoustic, vibratory, or ultrasonic pulses. The external signal generator 154 may be any device capable of generating a mechanical pulse to a wall, such as the wall or surface of a container or industrial equipment. For example, the external signal generator 154 may be an ultrasonic generator, an acoustic generator or a mechanical device capable of striking a wall at timed intervals (see FIGS. 4 and 5). The external device 150 may have a user interface (not shown) that a user may use to start the application of the external signal 140*b*. The controller 158 may receive an initiation signal corresponding to an external signal initiation request and pass a corresponding signal to the external signal generator 154 to start the application of the external signal 140*b*.

In one embodiment, the external signal generator 154 initiates the interrogation process by tapping a mechanical external signal (i.e., an initiation sequence) on the exterior wall of the container with a hard device such as a knocker. Each tap provides an acoustic pulse. The mechanical external signal may be any possible series of pulses and time lapses. For example and not by limitation, a mechanical external signal representing an initiation sequence may be two pulses separated by a one second time lapse. As described above, the external signal generator 154 may be a person tapping the container with a hammer, or a device capable of applying the pulses.

The external signal 140*b* is wirelessly transmitted through the wall as mechanical energy and is received by the internal signal receiver 106, thereby initiating an interrogation procedure. The internal signal receiver 106 may be a microphone or any device capable of detecting mechanical energy such as acoustic, vibratory, and ultrasonic energy. Once the external signal 140*b* is received, the controller 108 (or the internal signal receiver 106) instructs the environmental sensor 102 to provide data relating to a presence of a substance within the container. In other words, the controller 108 or internal signal receiver 106 may instruct the environmental sensor 102 to provide a report in the form of a status signal that either a contraband substance is present or a contraband substance is not present. The environmental sensor 102 may be operable to continuously detect substances and present a corresponding status signal, or may be operable to detect substances and present a corresponding status signal only when a mechanical external signal 140*b* is received. The status signal provided by the environmental sensor 102 may also be logged and stored in the internal sensor device memory 110.

Based on the data relating to the presence of substances gathered by the environmental sensor 102, the internal signal generator 104, which may be in electrical communication with the environmental sensor 102 (e.g., through the controller 108), may provide a mechanical report sequence 140*a* to an interior surface of a container wall (e.g., wall 113 of FIG. 1). The mechanical report sequence 140*a* that is provided will depend on the status signal provided by the sensor. As described above, the mechanical report sequence 140*a* may comprise a series of pulses in the form of acoustic and/or vibratory energy. Similar to the external signal generator 154, the internal signal generator 104 may be any device capable of generating a mechanical pulse to a wall or surface. For example, the internal signal generator 104 may be an ultrasonic generator, an acoustic generator or a mechanical device capable of striking a wall at timed intervals (see FIGS. 4 and 5).

More specifically, the mechanical report sequence 140*a* represents coded acoustic or vibratory energy and may be used as a method of wireless communication through a shielded wall or a container or other similar device. Unlike conventional sensor devices that utilize electromagnetic pulses as a method of wireless communication, embodiments of the present disclosure use a series of acoustic and/or vibratory pulses to send data to and from an internal and external device. This series of pulses representing coded data may be as simple as a single timed pulse indicating a "YES" or a "NO," or may comprise a complex string of data or instructions. As an example and not a limitation, the mechanical report sequence for a clean, i.e., no contraband, report may be one pulse followed by a two second delay and then another pulse. The report sequence sent by the internal signal generator for a contraband-present report may be one pulse followed by a one second delay and then another pulse. Any number of reporting sequence methods may be used depending on the reporting environment. Further, uniquely coded sequences may be utilized to correspond with particular types of substances. For example, one coded sequence may correspond with narcotics while another coded sequence may correspond with nuclear material.

The external receiver 156 receives and decodes the mechanical report sequence 140*a* to arrive at a decoded status signal that corresponds to whether or not the environmental sensor 102 has detected a contraband substance or substances. In one embodiment, the external signal receiver 156 may be a human ear that listens for and times the mechanical pulses to decode the mechanical report sequence 140*a*. The external receiver 156 may also be a component of the external device 150 that is configured as a microphone or other device capable of detecting acoustic and/or vibratory pulses. The external receiver 156 and controller 158 may be programmed such that the received mechanical report sequence is decoded to generate a decoded status signal representing a status of the container.

The external device 150 may comprise a status indicator (not shown) that may be configured to provide a message to a user regarding the status of the container. For example, the status indicator may comprises a green light and a red light, wherein a green light corresponds with a decoded status signal indicating that a contraband substance is not present while a red light corresponds with a decoded status signal indicating that a contraband substance is present. The status indicator may also comprise an LCD or similar display capable of displaying to a user the particular type or types of contraband substances indicated by the decoded status signal. Further, the decoded reporting sequence may be logged and stored in the external device memory 160. The decoded mechanical report sequence may also be transmitted to a remote computer 170 for analysis and storage.

The internal sensor device 101 may also be capable of operating in a plurality of different modes. For example, each mode may correspond with a particular class or particular type of contraband substance (e.g., narcotics, nuclear, biological, etc.). The external signal generator 154 of the external device 150 may instruct the internal sensor device 101 to switch from one mode to another mode by transmitting a mechanical mode sequence that is sent via a series of mechanical pulses to the internal signal receiver 106. The mechanical mode sequences may be similar to the mechanical external signal that initiates an interrogation but may comprise different pulses and pauses between pulses.

Figure 4:
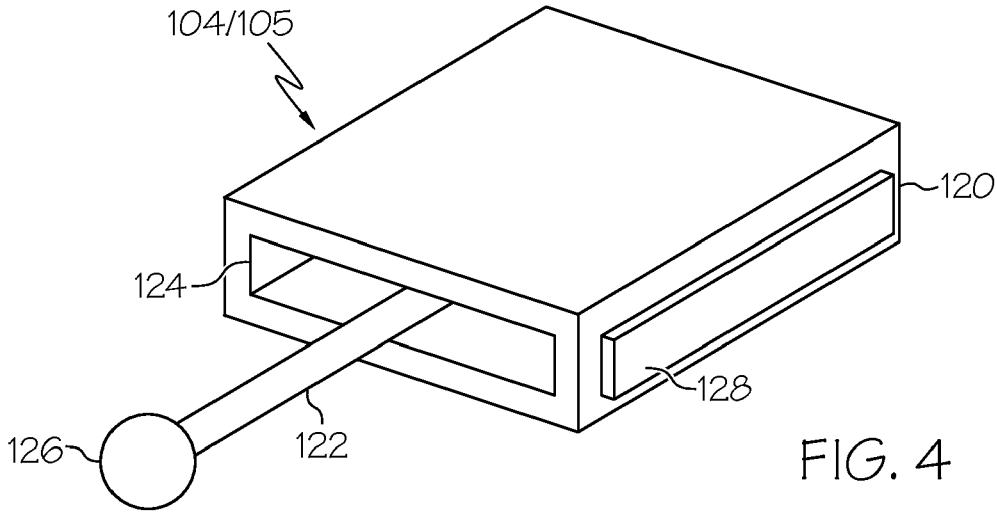
FIG. 4 depicts an exemplary internal or external signal generator according to one or more embodiments illustrated and described herein.
Figure 5:
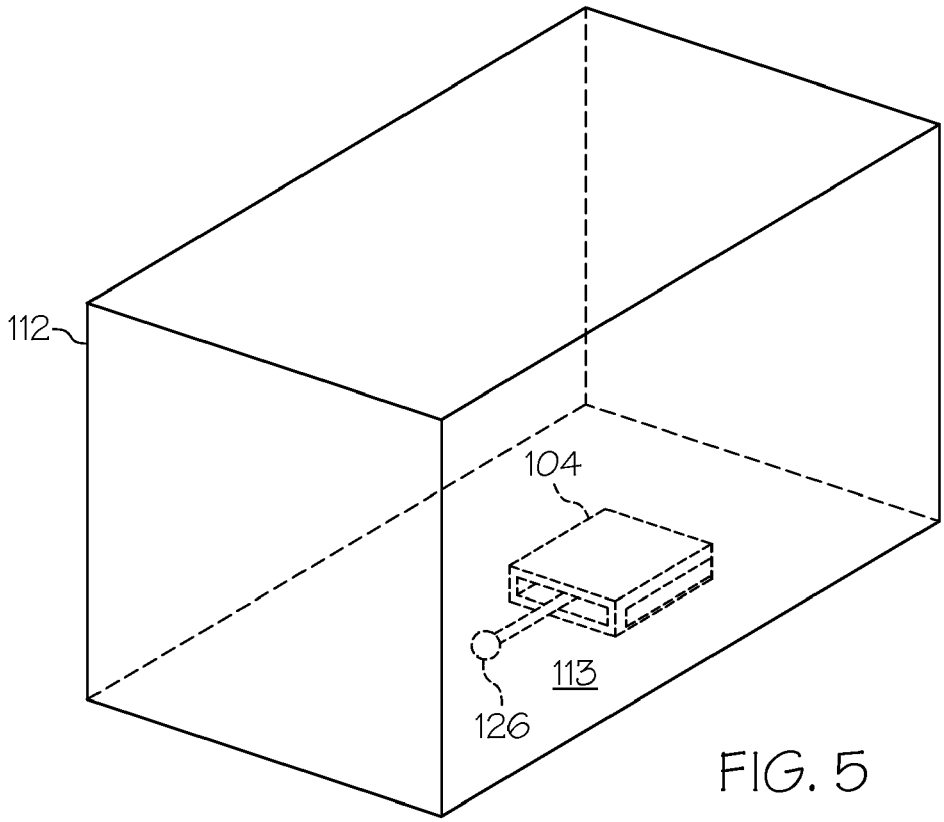
FIG. 5 depicts an exemplary internal or external signal generator coupled to an interior surface of a container according to one or more embodiments illustrated and described herein.

FIGS. 4 and 5 illustrate one embodiment of an internal or external signal generator 104/154 that is configured as a mechanical knocker device. In reference to an internal signal generator 104, a knocker device may be attached to an interior wall 113 of a container by an attachment mechanism 128 such as adhesive, magnets, Velcro, slots and the like. The knocker device comprises a knocker housing 120, a motor (not shown), a knocker arm 122 and a knocker element 126. The knocker arm 122 may extend through the knocker housing 120 through a slot 124. Upon receiving a control signal from the controller 108 or the internal signal receiver 106, the motor may activate to swing the knocker arm 122 back and forth such that the knocker element 126 strikes an interior surface of the wall 113, thereby generating a mechanical pulse that forms the mechanical report sequence that is wirelessly transmitted to the external signal receiver 156. It should be understood that this is only one configuration of a knocker device, and that other devices may be utilized as the internal signal generator 104 and the external signal generator 154, such as sound generators, vibrators, and ultrasonic generators, for example.

It should be understood that embodiments of the present disclosure provide for environmental sensing systems, devices and methods that detect a status of an enclosure such as the presence of contraband substances and wirelessly transmit a corresponding mechanical report sequence by acoustic, vibratory, and/or ultrasonic pulses. An environmental sensing device may be maintained within an enclosure as an internal sensing device to detect the presence of contraband substances or other enclosure status parameters. In accordance with a reporting schedule or a received external signal requesting a report, the internal sensing device may generate a mechanical report sequence applied to an interior surface of a wall. An external device or person may receive and decode the mechanical report sequence to determine a status of the enclosure so that appropriate action may be taken.

While the figures and other information submitted herewith may contain specific reference to size and material specifications, it should be understood that these references are illustrative of one or more embodiments and that the size of various component parts may be scaled up or down and the material specifications adjusted to cover various other additional embodiments while still retaining the same functionality of the bottom loading coupler, handle shaft assembly and stuff box described herein.

While particular embodiments and aspects of the present invention have been illustrated and described herein, various other changes and modifications can be made without departing from the spirit and scope of the invention. Moreover, although various inventive aspects have been described herein, such aspects need not be utilized in combination. It is therefore intended that the appended claims cover all such changes and modifications that are within the scope of this invention.

The invention claimed is:

1. An environmental sensing device comprising an environmental sensor and an internal signal generator, wherein:

the environmental sensing device is configured to be mechanically coupled to one or more interior surfaces of an enclosure;

the environmental sensor is operable to detect one or more substances within the enclosure and provide a status signal to the internal signal generator corresponding to the presence of the one or more substances; and the internal signal generator is operable to generate a mechanical report sequence corresponding to the status signal and comprising a series of mechanical pulses applied to an interior surface of the enclosure.

2. The environmental sensing device of claim 1 wherein the internal signal generator comprises one or more of the following:

a knocker device comprising a motor and a knocker element, the knocker device operable to generate the mechanical report sequence by operating the motor such that the knocker element strikes the interior surface of the enclosure to form a series of one or more pulses;

an ultrasonic generator operable to generate the mechanical report sequence by providing a series of one or more ultrasonic pulses to the interior surface of the enclosure; and a vibrating element operable to generate the mechanical report sequence by providing a series of one or more vibratory pulses to the interior surface of the enclosure.

3. The environmental sensing device of claim 1 wherein a first mechanical report sequence corresponds to a status signal indicating no detection of the one or more substances, and a second mechanical report sequence corresponds to a status signal indicating a detection of the one or more substances.

4. The environmental sensing device of claim 1 wherein the mechanical report sequence is operable to indicate one or more particular substances.

5. The environmental sensing device of claim 1 wherein:

the environmental sensor is configured to operate in a plurality of sensor modes; and each sensor mode of the plurality of sensor modes corresponds to the detection of a particular class of substance.

6. The environmental sensing device of claim 1 wherein the environmental sensing device further comprises a memory operable to store a sensor log comprising a plurality of received status signals.

7. The environmental sensing device of claim 1 wherein the internal signal generator is operable to generate the mechanical report sequence in accordance with a signal generating schedule.

8. The environmental sensing device of claim 1 wherein:

the environmental sensing device further comprises an internal signal receiver operable to receive a mechanical external signal corresponding to an initiation sequence; and the internal signal generator is operable to generate the mechanical report sequence upon receipt of the mechanical external signal.

9. The environmental sensing device of claim 8 wherein the mechanical external signal comprises a series of mechanical pulses applied to one or more exterior surfaces of the enclosure.

10. An environmental sensing system comprising an internal sensor device and an external device, wherein:

the internal sensor device comprises an environmental sensor, an internal signal generator, and an internal signal receiver;

the external device comprises an external signal receiver;

the internal sensor device is configured to be mechanically coupled to one or more interior surfaces of an enclosure;

the environmental sensor is operable to detect one or more substances within the enclosure and provide a status signal corresponding to a presence of the one or more substances;

the internal signal generator is operable to receive the status signal from the environmental sensor and upon receipt of a mechanical external signal generate a mechanical report sequence corresponding to the status signal and comprising a series of mechanical pulses applied to an interior surface of the enclosure; and the external signal receiver is operable to receive and decode the mechanical report sequence to generate a decoded status signal.

11. The environmental sensing system of claim 10 wherein the external device further comprises an external signal generator operable to apply the mechanical external signal to the exterior surface of the enclosure.

12. The environmental sensing system of claim 11 wherein the external signal generator comprises one or more of the following:

a knocker device comprising a motor and a knocker element, the knocker device operable to generate the mechanical external signal by operating the motor such that the knocker element strikes the interior surface of the enclosure to form a series of one or more pulses;

an ultrasonic generator operable to generate the mechanical external signal by providing a series of one or more ultrasonic pulses to the interior surface of the enclosure; and a vibrating element operable to generate the mechanical external signal by providing a series of one or more vibratory pulses to the interior surface of the enclosure.

13. The environmental sensing system of claim 10 wherein the internal signal generator comprises one or more of the following:

a knocker device comprising a motor and a knocker element, the knocker device operable to generate the mechanical report sequence by operating the motor such that the knocker element strikes the interior surface of the enclosure to form a series of one or more pulses;

an ultrasonic generator operable to generate the mechanical report sequence by providing a series of one or more ultrasonic pulses to the interior surface of the enclosure; and a vibrating element operable to generate the mechanical report sequence by providing a series of one or more vibratory pulses to the interior surface of the enclosure.

14. The environmental sensing system of claim 10 wherein a first mechanical report sequence corresponds to a status signal indicating no detection of the one or more substances, and a second mechanical report sequence corresponds to a status signal indicating a detection of the one or more substances.

15. The environmental sensing system of claim 10 wherein the internal sensor device further comprises an internal sensor device memory operable to store an internal sensor log comprising a plurality of received status signals.

16. The environmental sensing system of claim 10 wherein the external device further comprises an external device memory operable to store an external sensor log comprising a plurality of decoded status signals.

17. The environmental sensing system of claim 10 wherein the external device further comprises a wireless communications module operable to wirelessly transmit the decoded status signal to a remote computing device.

18. The environmental sensing system of claim 10 wherein:

the environmental sensor is configured to operate in a plurality of sensor modes; and each sensor mode of the plurality of sensor modes corresponds to the detection of a particular class of substance.

19. A method of reporting a status of an enclosure comprising:

providing a mechanical external signal comprising a series of mechanical pulses applied to an exterior surface of an enclosure;

receiving the mechanical external signal by an internal sensor device positioned within the enclosure;

determining a status of the enclosure and providing a status signal corresponding to the status of the enclosure;

generating with the internal sensor device a mechanical report sequence in response to the receipt of the mechanical external signal, wherein the mechanical report sequence comprises a series of mechanical pulses applied to an interior surface of the enclosure and corresponds with the status signal;

receiving the mechanical report sequence; and decoding the mechanical report sequence to generate a decoded status signal.

20. The method of claim 19 wherein the method further comprises transmitting the decoded status signal to a remote computing device.

* * * * *